US008697323B2

(12) United States Patent
Kmiecik-Lawrynowicz et al.

(10) Patent No.: US 8,697,323 B2
(45) **Date of Patent: *Apr. 15, 2014**

(54) LOW GLOSS MONOCHROME SCD TONER FOR REDUCED ENERGY TONER USAGE

(75) Inventors: Grazyna E. Kmiecik-Lawrynowicz, Fairport, NY (US); Brian S. Wang, Webster, NY (US); Robert D. Bayley, Fairport, NY (US); Maura A. Sweeney, Irondequoit, NY (US); Daniel W. Asarese, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/438,321

(22) Filed: Apr. 3, 2012

(65) Prior Publication Data

US 2013/0260303 A1 Oct. 3, 2013

(51) Int. Cl.
*G03G 9/08* (2006.01)

(52) U.S. Cl.
USPC ..... 430/108.3; 430/108.7; 430/137.14

(58) Field of Classification Search
USPC ..... 430/108.24, 108.3, 108.7, 137.14
See application file for complete search history.

(56) References Cited

U.S. PATENT DOCUMENTS

| | | | | |
|---|---|---|---|---|
| 2,874,063 | A | 2/1959 | Greig | |
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,265,990 | A | 5/1981 | Stolka et al. | |
| 4,298,672 | A | 11/1981 | Lu | |
| 4,338,390 | A | 7/1982 | Lu | |
| 4,563,408 | A | 1/1986 | Lin et al. | |
| 4,584,253 | A | 4/1986 | Lin et al. | |
| 4,585,884 | A | 4/1986 | Lin et al. | |
| 5,278,020 | A | 1/1994 | Grushkin et al. | |
| 5,290,654 | A | 3/1994 | Sacripante et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,348,832 | A | 9/1994 | Sacripante et al. | |
| 5,364,729 | A | 11/1994 | Kmiecik-Lawrynowicz et al. | |
| 5,366,841 | A | 11/1994 | Patel et al. | |
| 5,370,963 | A | 12/1994 | Patel et al. | |
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,943 | A | 12/1998 | Cheng et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 6,004,714 | A | 12/1999 | Ciccarelli et al. | |
| 6,190,815 | B1 | 2/2001 | Ciccarelli et al. | |
| 6,566,025 | B1 * | 5/2003 | McStravick et al. | 430/108.11 |
| 6,576,389 | B2 | 6/2003 | Vanbesien et al. | |
| 6,610,452 | B2 * | 8/2003 | Combes et al. | 430/108.11 |
| 6,617,092 | B1 | 9/2003 | Patel et al. | |
| 6,627,373 | B1 | 9/2003 | Patel et al. | |
| 6,638,677 | B2 | 10/2003 | Patel et al. | |
| 6,656,657 | B2 | 12/2003 | Patel et al. | |
| 6,656,658 | B2 | 12/2003 | Patel et al. | |
| 6,664,017 | B1 | 12/2003 | Patel et al. | |
| 6,673,505 | B2 | 1/2004 | Jiang et al. | |
| 6,730,450 | B1 | 5/2004 | Moffat et al. | |
| 6,743,559 | B2 | 6/2004 | Combes et al. | |
| 6,756,176 | B2 | 6/2004 | Stegamat et al. | |
| 6,830,860 | B2 | 12/2004 | Sacripante et al. | |
| 7,029,817 | B2 | 4/2006 | Robinson et al. | |
| 7,402,370 | B2 | 7/2008 | Kmiecik-Lawrynowicz et al. | |
| 7,704,662 | B2 | 4/2010 | Kmiecik-Lawrynowicz et al. | |
| 7,704,665 | B2 | 4/2010 | Kmiecik-Lawrynowicz et al. | |
| 8,394,566 | B2 * | 3/2013 | Kmiecik-Lawrynowicz et al. | 430/108.2 |
| 2005/0250030 | A1 * | 11/2005 | McStravick et al. | 430/108.6 |
| 2006/0003244 | A1 * | 1/2006 | Grande et al. | 430/106.2 |
| 2007/0087280 | A1 * | 4/2007 | Patel et al. | 430/110.2 |
| 2008/0107989 | A1 | 5/2008 | Sacripante et al. | |
| 2008/0153027 | A1 * | 6/2008 | Veregin et al. | 430/113 |
| 2008/0247788 | A1 * | 10/2008 | Ayaki et al. | 399/321 |
| 2012/0129088 | A1 * | 5/2012 | Kmiecik-Lawrynowicz et al. | 430/108.3 |
| 2012/0129089 | A1 * | 5/2012 | Kmiecik-Lawrynowicz et al. | 430/108.3 |

FOREIGN PATENT DOCUMENTS

| | | |
|---|---|---|
| GB | 1 442 835 | 7/1976 |

OTHER PUBLICATIONS

May 8, 2012 Office Action issued in U.S. Appl. No. 12/954,281.
Feb. 20, 2013 Office Action issued in U.S. Appl. No. 12/954,332.

(Continued)

*Primary Examiner* — Jonathan Jelsma
(74) *Attorney, Agent, or Firm* — Oliff PLC

(57) ABSTRACT

A toner composition including toner particles that have a resin, an optional wax, and an optional colorant; and a surface additive at least partially coating toner particle surfaces. The surface additive includes a mixture of a hexamethyldisilazane (HMDS) surface treated silica, a sol-gel silica that is not surface treated, and a polydimethylsiloxane (PDMS) surface treated silica.

22 Claims, No Drawings

(56) References Cited

OTHER PUBLICATIONS

U.S. Appl. No. 12/954,332, filed Nov. 24, 2010 in the name of Kmiecik-Lawrynowicz et al.

U.S. Appl. No. 12/575,718, filed Oct. 8, 2009.
U.S. Appl. No. 12/954,281, filed Nov. 24, 2010.
Jun. 12, 2013 Office Action issued in U.S. Appl. No. 12/954,332.

* cited by examiner

LOW GLOSS MONOCHROME SCD TONER FOR REDUCED ENERGY TONER USAGE

BACKGROUND

This disclosure is generally directed to toner compositions, and methods for producing such toners, for use in forming and developing images of good quality. More specifically, this disclosure is directed to toner compositions exhibiting low minimum fusing temperatures and gloss levels, and methods for producing such compositions. Such compositions are useful, for example, as monochrome toners in single component development (SCD) systems.

Higher speed single component printers have been built to satisfy the higher demands of the office network market. Current toner formulations lack minimum fusing temperature sufficient to prevent issues with cold offset and heavy weight paper along with poorer fusing with increased printer speed. In monochrome formulations, high gloss is also not optimal for specific applications, especially text.

There remains a need for an improved toner composition and process that overcomes or alleviates the above-described and other problems. There further remains a need for a toner composition suitable for high speed printing, particularly high speed monochrome printing that can provide excellent flow, charging, lower toner usage, and reduced drum contamination, while maintaining gloss levels suitable for a matte finish.

SUMMARY

This disclosure addresses some or all of the above problems, and others, by providing new toner compositions including a novel additive package. This disclosure thus relates to toners, developers containing toners, and devices for generating developed images with, for example, high print quality.

Herein is disclosed a toner composition comprising toner particles that comprise a resin, an optional wax, and an optional colorant; and a surface additive at least partially coating toner particle surfaces. The surface additive comprises a mixture of a hexamethyldisilazane (HMDS) surface treated silica, a sol-gel silica that is not surface treated, and a polydimethylsiloxane (PDMS) surface treated silica.

Also disclosed is a method of making a toner composition by forming a slurry by mixing together an emulsion containing a resin, optionally a wax, optionally a colorant, optionally a surfactant, optionally a coagulant, and one or more additional optional additives; heating the slurry to fowl aggregated particles in the slurry; freezing aggregation of the particles by adjusting the pH; heating the aggregated particles in the slurry to coalesce the particles into toner particles; recovering the toner particles; and coating the toner particles with a surface additive comprising a mixture of a hexamethyldisilazane (HMDS) surface treated silica, a sol-gel silica that is not surface treated, and a polydimethylsiloxane (PDMS) surface treated silica.

EMBODIMENTS

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

For single component developers, i.e. developers that contain no charge carriers as in two component developers, it is important for the toner particles to exhibit high transfer efficiency, including excellent flow properties and low cohesivity. The toners described herein as embodiments have appropriate compositions and physical properties to be suited for use in single component developer machines. These compositions and properties will be detailed below.

Resins and Polymers

Any monomer suitable for preparing a latex for use in a toner may be used. The toner may be produced by emulsion aggregation. Suitable monomers useful in forming a latex polymer emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like.

As the toner (or binder) resin, any of the conventional toner resins may be used. Illustrative examples of suitable toner resins include, for example, thermoplastic resins such as vinyl resins in general or styrene resins in particular, and polyesters. Examples of suitable thermoplastic resins include styrene methacrylate; polyolefins; styrene acrylates, styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include styrene; p-chlorostyrene; unsaturated mono-olefins such as ethylene, propylene, butylene, isobutylene, and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; mixtures thereof; and the like. In addition, crosslinked resins, including polymers, copolymers, and homopolymers of styrene polymers may be selected.

The latex polymer may include at least one polymer. Exemplary polymers include poly-styrene acrylates, poly-styrene butadienes, poly-styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), polystyrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

A poly(styrene-butyl acrylate) may be used as the latex polymer. The glass transition temperature of this latex may be from about 35° C. to about 75° C., such as from about 40° C. to about 70° C., or from about 45° C. to about 65° C.

The polymeric resin or latex polymer may be present in an amount of from about 40 wt % to about 90 wt % of the toner, such as from about 50 wt % to about 90 wt %, or from about 65 wt % to about 85 wt %. The polymeric resin or latex polymer may have an average molecular weight of from about 20,000 pse (Poly Styrene Equivalents) to about 100,000 pse, such as from about 20,000 pse to about 60,000 pse, or from about 50,000 pse to about 100,000 pse, and a number average molecular weight of from about 8,000 pse to about 40,000 pse, such as from about 8,000 pse to about 25,000 pse, or from about 15,000 pse to about 35,000 pse.

The molecular weight may be measured by mixed bed gel permeation chromatography.

Waxes

In addition to the polymer binder resin, the toners may also contain a wax, either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

The wax may be selected from polypropylenes and polyethylenes commercially available. The commercially available polyethylenes usually possess a molecular weight (Mw) of from about 500 to about 2,000, such as from about 1,000 to about 1,500, or from about 750 to about 1,250, while the commercially available polypropylenes used have a molecular weight of from about 1,000 to about 10,000, such as from about 1,000 to about 6,000, or from about 4,000 to about 9,000. Examples of functionalized waxes include amines, amides, imides, esters, quaternary amines, carboxylic acids or acrylic polymer emulsion, and chlorinated polyethylenes and polypropylenes commercially available. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt %, or from about 12 to about 25 wt % of the toner, on a dry basis; or from about 5 to about 20 wt % of the toner, or from about 5 to about 12 wt % of the toner.

In some embodiments, the wax is a paraffin wax. Suitable paraffin waxes include paraffin waxes possessing modified crystalline structures, which may be referred to herein as modified paraffin waxes. Compared with conventional paraffin waxes, which may have a symmetrical distribution of linear carbons and branched carbons, the modified paraffin waxes may possess branched carbons in an amount of from about 1 to about 20 wt % of the wax, such as from about 8 to about 16 wt % or from about 3 to about 10 wt % of the wax, with linear carbons present in an in amount of from about 80 to about 99 wt % of the wax, such as from about 84 to about 92 wt % or from 90 to about 96 wt % of the wax.

In addition, the isomers, i.e., branched carbons, present in such modified paraffin waxes may have a number average molecular weight (Mn), of from about 520 to about 600, such as from about 550 to about 570, or about 560. The linear carbons, sometimes referred to herein as normals, present in such waxes may have a Mn of from about 505 to about 530, such as from about 512 to about 525, or about 518. The weight average molecular weight (Mw) of the branched carbons in the modified paraffin waxes may be from about 530 to about 580, such as from about 555 to about 575, or from about 540 to about 560, and the Mw of the linear carbons in the modified paraffin waxes may be from about 480 to about 550, such as from about 515 to about 535, or from about 500 to about 520.

For the branched carbons, the weight average molecular weight (Mw) of the modified paraffin waxes may demonstrate a number of carbon atoms of from about 31 to about 59 carbon atoms, such as from about 34 to about 50 carbon atoms, or from about 38 to 45 carbon atoms, with a peak at about 41 carbon atoms, and for the linear carbons, the Mw may demonstrate a number of carbon atoms of from about 24 to about 54 carbon atoms, or from about 30 to about 50 carbon atoms, or from about 27 to about 40 carbon atoms, with a peak at about 36 carbon atoms.

The modified paraffin wax may be present in an amount of from about 2 to about 20 wt % by weight of the toner, such as from about from about 4 to about 15 wt % by weight of the toner, or from about 5 to about 13 wt % by weight of the toner.

Colorants

The toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %, or from about 5 to about 15 wt %.

In general, suitable colorants include Carbon blacks such as; Black Pearl 1400; Black Pearls; Black Pearls 1000; Black Pearls 1100; Black Pearls 120; Black Pearls 130; Black Pearls 1300; Black Pearls 1300A73; Black Pearls 1400; Black Pearls 160; Black Pearls 2000; Black Pearls 280; Black Pearls 3200; Black Pearls 3500; Black Pearls 3550; Black Pearls 3700; Black Pearls 420; Black Pearls 430; Black Pearls 4350; Black Pearls 4560; Black Pearls 460; Black Pearls 4750; Black Pearls 480; Black Pearls 490; Black Pearls 6100; Black Pearls 700; Black Pearls 800; Black Pearls 8500; Black Pearls 880; Black Pearls 900; Black Pearls L, (Cabot), Regal® Carbon Blacks such as: Regal 1250R; Regal 1330; Regal 1330R; Regal 250; Regal 250R; Regal 300; Regal 300R; Regal 330; Regal 330R; Regal 350R; Regal 400; Regal 400R; Regal 415R; Regal 500R; Regal 600; Regal 660; Regal 660R; Regal 700; Regal 85; Regal 99; Regal 991; Regal 99R; Regal Black 250R; Regal L; Regal R 330; Regal SRF; Regal SRF-S (Cabot), Conductex® carbon blacks such as Conductex 40-200; Conductex 40-220; Conductex 7051; Conductex 7055 Ultra; Conductex 900; Conductex 950; Conductex 975; Conductex 975 Ultra; Conductex 975U; Conductex CC 40-220; Conductex N 472; Conductex SC; Conductex SC Ultra; Conductex SC-U (Columbian Chemicals), Raven® carbon blacks such as Raven 1000; Raven 1000BDS; Raven 1020; Raven 1035; Raven 1040; Raven 1060; Raven 1060B; Raven 1080; Raven 11; Raven 1100; Raven 1100 Ultra; Raven 1170; Raven 1190 Ultra; Raven 1200; Raven 12200; Raven 125; Raven 1250; Raven 1255; Raven 1255B; Raven 14; Raven 15; Raven 150; Raven 1500; Raven 16; Raven 200; Raven 2000; Raven 22; Raven 22D; Raven 2500; Raven 2500 Powder U; Raven 2500 Ultra; Raven 30; Raven 3200; Raven 35; Raven 350; Raven 3500; Raven 360; Raven 3600 Ultra; Raven 3600U; Raven 40; Raven 403UB; Raven 410; Raven 410U; Raven 420; Raven 420 Dense; Raven 430; Raven 430 Ultra; Raven 430UB; Raven 450; Raven 50; Raven 500; Raven 5000; Raven 5000 Ultra II; Raven 5000U111; Raven 520; Raven 5250; Raven 5720; Raven 5750; Raven 7000; Raven 760; Raven 760 Ultra; Raven 76013; Raven 780; Raven 780 Ultra; Raven 8000; Raven 860; Raven 860 Ultra; Raven 860U; Raven 880 Ultra; Raven 890; Raven Beads; Raven Black; Raven C; Raven P-FE/B (Columbian Chemicals). Levanyl B-LF; Levanyl Black A-SF; Levanyl Black B-LF; Levanyl Black BZ; Levanyl Black N-LF; Levanyl N-LF (LanXess). Mitsubishi® Carbon blacks such as: Mitsubishi 1000; Mitsubishi 20B; Mitsubishi 2400; Mitsubishi 2400B; Mitsubishi 258; Mitsubishi 260; Mitsubishi 2770B; Mitsubishi 30; Mitsubishi 3030; Mitsubishi 3050; Mitsubishi 30B; Mitsubishi 3150; Mitsubishi 33B; Mitsubishi 3400; Mitsubishi 40; Mitsubishi 44; Mitsubishi 45; Mitsubishi 47; Mitsubishi 50; Mitsubishi 5B; Mitsubishi 650; Mitsubishi 900; Mitsubishi 970; Mitsubishi 980B; Mitsubishi 990B; Mitsubishi Carbon 10; Mitsubishi Carbon 25; Mitsubishi Carbon 40; Mitsubishi Carbon 44; Mitsubishi Carbon 45; Mitsubishi Carbon 50; Mitsubishi Carbon 52; Mitsubishi Carbon Black 2000; Mitsubishi Carbon Black 2600; Mitsubishi Carbon Black 3050; Mitsubishi Carbon Black 33; Mitsubishi Carbon Black 44; Mitsubishi Carbon Black 900; Mitsubishi Carbon Black 950; Mitsubishi Carbon Black 970; Mitsubishi Carbon Black 990; Mitsubishi Carbon Black MA 100; Mitsubishi Carbon Black MA 220 (Mitsubishi). NiPex® carbon blacks such as Nipex 150G; Nipex 1501Q; Nipex 16; Nipex 160; Nipex 1601Q; Nipex 18; Nipex 180; Nipex 1801Q; Nipex 30; Nipex 60; Nipex 70; Nipex 85; Nipex 90 (Orion), Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan 11, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Other colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %. However, amounts outside these ranges can also be used.

Coagulants

Coagulants used in emulsion aggregation processes for making toners include monovalent metal coagulants, divalent metal coagulants, polyion coagulants, and the like. As used herein, "polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, or from about 7 to 13 aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt %, or from about 2 to about 5 wt % of the toner particles.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt % weight of the toner composition, or from about 1 to about 3 wt % of the toner composition.

Examples of suitable nonionic surfactants include, for example, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhône-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sultanate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Initiators

Initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be used include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators may be added in suitable amounts, such as from about 0.1 to about 8 wt % of the monomers, or from about 0.2 to about 5 wt % of the monomers, or from about 4 to about 8 wt % of the monomers.

Chain Transfer Agents

Chain transfer agents may also be used in forming the latex polymer. Suitable chain transfer agents include dodecane thiol, octane thiol, carbon tetrabromide, combinations thereof, and the like, in amounts from about 0.1 to about 10 wt %, such as from about 0.2 to about 5 wt %, or from about 1 to about 3 wt % of monomers, to control the molecular weight properties of the latex polymer when emulsion polymerization is conducted in accordance with the present disclosure.

Secondary Latex

A secondary latex may be added to the non-crosslinked latex resin dispersed by the surfactant. As used herein, a secondary latex may refer to a crosslinked resin or polymer, or mixtures thereof, or a non-crosslinked resin as described above, that has been subjected to crosslinking.

The secondary latex may include submicron crosslinked resin particles having a size of from about 10 to about 200 nanometers in volume average diameter, such as from about 20 to about 100 nanometers, or from about 90 to about 200 nanometers. The secondary latex may be suspended in an aqueous phase of water containing a surfactant, where the surfactant is present in an amount of from about 0.5 to about 5 wt % of total solids, such as from about 0.7 to about 2 wt %, or from about 1.5 to about 3.5 wt % of total solids.

The crosslinked resin may be a crosslinked polymer such as crosslinked poly-styrene acrylates, poly-styrene butadienes, and/or poly-styrene methacrylates. Exemplary crosslinked resins include crosslinked poly(styrene-alkyl acrylate), poly(styrene-butadiene), poly(styrene-isoprene), poly(styrene-alkyl methacrylate), poly(styrene-alkyl acrylate-acrylic acid), polystyrene-butadiene-acrylic acid), poly (styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly(alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25 wt % of the crosslinked resin, such as from about 0.5 to about 15 wt % or from about 1 to about 10 wt % of the crosslinked resin.

The crosslinked resin particles may be present in an amount of from about 1 to about 20 wt % of the toner, such as from about 5 to about 15 wt %, or from about 4 to about 14 wt % of the toner.

The resin used to form the toner may be a mixture of a gel resin and a non-crosslinked resin.

Functional Monomers

A functional monomer may be included when forming a latex polymer and the particles making up the polymer. Suitable functional monomers include monomers having carboxylic acid functionality. Such functional monomers may be of the following formula (I):

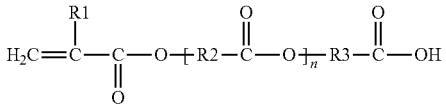

(I)

where R1 is hydrogen or a methyl group; R2 and R3 are independently selected from alkyl groups containing from about 1 to about 12 carbon atoms or a phenyl group; n is from about 0 to about 20, such as from about 1 to about 10, or from about 11 to 20. Examples of such functional monomers include beta carboxyethyl acrylate (β-CEA), poly(2-carboxyethyl) acrylate, 2-carboxyethyl methacrylate, combinations thereof, and the like. Other functional monomers that may be used include, for example, acrylic acid, methacrylic acid and its derivatives.

The functional monomer having carboxylic acid functionality may also contain a small amount of metallic ions, such as sodium, potassium, and/or calcium, to achieve better emulsion polymerization results. The metallic ions may be present in an amount from about 0.001 to about 10 wt % of the functional monomer having carboxylic acid functionality, such as from about 0.5 to about 5 wt %, or from about 1 to about 3 wt %.

Where present, the functional monomer may be added in amounts from about 0.01 to about 8 wt % of the toner, such as from about 0.05 to about 4 wt %, or from about 0.1 to about 1 wt % of the toner.

Chelating agents may optionally be added. Suitable chelating agents include a polydentate ligand, for example ethylenediaminetetraacetic acid (EDTA), diethylene triamine pentaacetic acid (DTPA), or ethylene glycol tetraacetic acid (EGTA). The polydentate ligand may be in an aqueous solution. The chelator may be added in amounts from about 0.01 to about 6 wt % of the toner, such as from about 0.05 to about 4 wt % of the toner, or from about 0.1 to about 1 wt % of the toner.

Aggregating Agents

Any aggregating agent capable of causing complexation might be used in forming toners of the present disclosure. Both alkali earth metal or transition metal salts can be utilized as aggregating agents. Alkali (II) salts can be selected to aggregate latex resin colloids with a colorant to enable the formation of a toner composite. Such salts include beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions suitable as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

Shell

A shell may be formed on the aggregated particles. Any latex noted above used to form the core latex may be used to form the shell latex. In some embodiments, a styrene-n-butyl acrylate copolymer is used to form the shell latex. The shell latex may have a glass transition temperature of from about 40° C. to about 75° C., such as from about 45° C. to about 70° C., or from about 50° C. to about 65° C.

Where present, a shell latex may be applied by any method within the purview of those skilled in the art, including dipping, spraying, and the like. The shell latex may be applied until the desired final size of the toner particles is achieved, such as from about 3 to about 12 microns, such as from about 4 microns to about 9 microns, or from about 5 to about 8 microns. The shell latex may be prepared by in-situ seeded semi-continuous emulsion copolymerization of the latex and the shell latex being added once aggregated particles have formed.

Where present, the shell latex may be present in an amount of from about 20 to about 40 wt % of the dry toner particle, such as from about 26 to about 36 wt %, or from about 27 to about 34 wt % of the dry toner particle.

Methods

Toners of the present disclosure may be prepared by combining at least a latex polymer, a wax, and an optional colorant in the aggregation and coalescence process, followed by the washing and drying of the particles and then blending toner particles with a surface additive package. The latex polymer may be prepared by any method within the purview of those skilled in the art. One way the latex polymer may be prepared is by emulsion polymerization methods, including semi-continuous emulsion polymerization.

Emulsion aggregation procedures typically include the basic process steps of mixing together an emulsion containing a polymer or a resin, optionally one or more waxes, optionally one or more colorants, optionally one or more surfactants, an optional coagulant, and one or more additional optional additives to form a slurry; heating the slurry to form aggregated particles in the slurry; optionally adding the shell and freezing aggregation of the particles by adjusting the pH; and heating the aggregated particles in the slurry to coalesce the particles into toner particles; and then washing and drying the obtained emulsion aggregation toner particles.

pH Adjustment Agent

A pH adjustment agent may be added to control the rate of the emulsion aggregation and the coalescence process. The pH adjustment agent may be any acid or base that does not adversely affect the products being produced. Suitable bases include metal hydroxides, such as sodium hydroxide, potassium hydroxide, ammonium hydroxide, and combinations thereof. Suitable acids include nitric acid, sulfuric acid, hydrochloric acid, citric acid, acetic acid, and combinations thereof.

Surface Additive Package

A surface additive package may be applied to the toner particles. The additive package generally coats or adheres to external surfaces of the toner particles, rather than being incorporated into the bulk of the toner particles. The components of the additive package are selected to enable superior toner flow properties, high toner charge, charge stability, denser images, and lower drum contamination.

The surface additive package may comprise a first silica and a second silica, where the first silica is surface treated with hexamethyldisilazane (HMDS), and the second silica has an untreated surface, the second silica having a volume average diameter that is on the order of 10 to 20 times greater than the volume average diameter of the first silica. The HMDS silica may have a volume average diameter of from about 5 to about 700 nm, such as from about 10 to about 50 nm, or from about 20 to about 40 nm. The second silica may be a sol-gel silica. The second silica may have a volume average diameter of from about 100 to about 180 nm, such as from about 100 to about 170 nm, or from about 110 to about 160 nm, or from about 120 to about 150 nm. In some embodiments, 140 nanometer sol-gel silica is used.

The surface additive package may further comprise a polydimethylsiloxane (PDMS) silica. The PDMS silica may have a volume average diameter of from about 5 to about 700 nm, such as from about 10 to about 50 nm, or from about 20 to about 40 nm.

The HMDS surface treated silica may be present in an amount of from about 0.05 to about 2 wt % of the particle, such as from about 0.1 to about 1.0 wt %, or from about 0.2 to about 0.8 wt %, or from about 0.3 to about 0.70 wt %, or from about 0.45 to about 0.55 wt %. Also, the weight ratio of the HMDS surface treated silica to the sol-gel silica may be in a range of from about 4:1 to about 3:1. The sol-gel silica may be present in an amount of from about 0.0.05 to about 0.5 wt % of the particle, such as from about 0.10 to about 0.40 wt %, or from about 0.12 to about 0.35 wt %, or from about 0.15 to about 0.25 wt %. The PDMS silica may be present in an amount of from about 0.10 to about 3.00 wt % of the particle, such as from about 0.30 to about 2.8 wt %, or from about 0.40 to about 2.5 wt %, or from about 0.5 to about 2.25 wt %.

The external surface additive package may be present in an amount from about 2.5 to about 5 wt % of the toner particle, such as from about 3 to about 4.5 wt % of the particle, or from about 2.5 to about 3.5 wt % of the toner particle. The total additives package may be in the range of from about 3.0 to about 5.0 wt % of the toner, such as from about 3.0 to about 4.0 wt %, or from about 4.0 to about 5.0 wt %. The total of the different silicas in the surface additive package may be about 1.5 to about 5.0 wt %, such as from about 2 to about 4.0%, or from about 2.5 to about 3.9 wt %.

Other Optional Additives

In addition to the surface additive package described above, further optional additives may be combined with the toner. These include any additive to enhance the properties of toner compositions. For example, the toner may include positive or negative charge control agents in an amount, for example, of from about 0.1 to about 10 wt % of the toner, such as from about 1 to about 3 wt %. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E88™, or zinc salts such as E-84 (Orient Chemical); combinations thereof, and the like.

Other additives include an organic spacer, such as polymethylmethacrylate (PMMA). The organic spacer may have a volume average diameter of from about 300 to about 600 nm, such as from about 300 to about 400 nm, or from about 350 to about 450 nm, such as 300 nm, 350 nm, 400 mu, 450 nm, or 500 nm. In some embodiments, 400 nanometer PMMA organic spacer is used.

Other additives include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives may each be present in an amount of from about 0.1 to about 10 wt % of the toner, such as from about 0.5 to about 7 wt %, or from about 1 to about 5 wt %. Examples of such additives include, for example, those disclosed in U.S. Pat. Nos. 3,590,000, 3,720,617, 3,655,374, and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 wt % of the toner, such as from about 0.1 to about 2 wt %, or from about 1 to about 3 wt % of the toner. These additives may be added during the aggregation or blended into the formed toner product.

Toner Properties

Emulsion aggregation processes provide greater control over the distribution of toner particle sizes and by limiting the amount of both fine and coarse toner particles in the toner. In some embodiments, the toner particles have a relatively narrow particle size distribution with a lower number ratio geometric standard deviation (GSDn) of about 1.15 to about 1.40, such as from about 1.15 to about 1.25, or from about 1.18 to about 1.23. The toner particles may also exhibit an upper geometric standard deviation by volume (GSDv) in the range of from about 1.15 to about 1.35, such as from about 1.15 to about 1.30, or from about 1.18 to about 1.23.

The toner particles may have a volume average diameter (also referred to as "volume average particle diameter" or "$D_{50v}$") of from about 3 to about 25 μm, such as from about 4 to about 15 μm, or from about 6.5 to about 8 μm, or from about 6.5 to about 8 μm. $D_{50v}$, GSDv, and GSDn may be determined using a measuring instrument such as a Beckman Coulter Multisizer 3, operated in accordance with the manufacturer's instructions.

By optimizing the particle size, in some cases from about 6.5 to about 7.7 μm, toners of the present disclosure may be especially suited for bladeless cleaning systems, i.e., single component development (SCD) systems. With a proper sphericity, the toners of the present disclosure may assist in optimized machine performance.

The toner particles may have a circularity of about 0.940 to about 0.999, such as from about 0.950 to about 0.998, or from about 0.960 to about 0.998, or from about 0.970 to about 0.998, or from about 0.980 to about 0.990, from about greater than or equal to 0.962 to about 0.999, or from about greater than or equal to 0.965 to about 0.990. A circularity of 1.000 indicates a completely circular sphere. Circularity may be measured with, for example, a Sysmex FPIA 2100 or 3000 analyzer.

The toner particles may have a shape factor of from about 105 to about 160, such as from about 110 to about 140, or from about 120 to about 150 SF1*a. Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The toner particles may have a surface area of from about 0.5 $m^2/g$ to about 1.4 $m^2/g$, such as from about 0.6 $m^2/g$ to about 1.2 $m^2/g$, or from about 0.7 $m^2/g$ to about 1.0 $m^2/g$. Surface area may be determined by the Brunauer, Emmett, and Teller (BET) method. BET surface area of a sphere can be calculated by the following equation:

$$\text{Surface Area } (m^2/g)=6/(\text{Particle Diameter (um)}*\text{Density (g/cc)}).$$

The toner particles may have a weight average molecular weight (Mw) in the range of from about 20,000 to about 100,000 pse, such as from about 20,000 to about 60,000 pse, or from about 40,000 to about 100,000 pse, a number average molecular weight (Mn) of from about 8,000 to about 40,000 pse, such as from about 8,000 to about 25,000 pse, or from about 20,000 to about 40,000 pse, and an MWD (a ratio of the Mw to Mn of the toner particles, a measure of the polydispersity, or width, of the polymer) of from about 1.2 to about 10, such as from about 1.2 to about 5, or from about 4 to about 10.

The characteristics of the toner particles may be determined by any suitable technique and apparatus and are not limited to the instruments and techniques indicated hereinabove.

Further, the toners, if desired, can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder, which represents the highest peak of the Mw. In the present disclosure, the binder can have Mp values in the range of from about 5,000 to about 50,000 pse, such as from about 7,500 to about 45,000 pse, or from about 15,000 to about 30,000 pse.

In an electrophotographic apparatus, the lowest temperature at which toner adheres to the fuser roll is called the cold offset temperature; the maximum temperature at which the toner does not adhere to the fuser roll is called the hot offset temperature. When the fuser temperature exceeds the hot offset temperature, some of the molten toner adheres to the fuser roll during fixing, is transferred to subsequent substrates (phenomenon known as "offsetting"), resulting in blurred images. Between the cold and hot offset temperatures of the toner is the minimum fix temperature (MFT), which is the minimum temperature at which acceptable adhesion of the toner to the support medium occurs. The difference between minimum fix temperature and hot offset temperature is called the fusing latitude. The rheology of toners, especially at high temperatures, may be affected by the length of the polymer chain utilized to form the binder resin as well as any crosslinking or the formation of a polymer network in the binder resin.

The toners may possess low minimum fix temperatures, i.e., temperatures at which images produced with the toner may become fixed to a substrate, of from about 135° C. to about 220° C., such as from about 145° C. to about 215° C., or from about 155° C. to about 185° C.

The toner compositions may have a gloss, measured at the minimum fixing temperature (MFT), of from about 5 to about 30 gloss units, such as from about 5 to about 20 gloss units, or from about 10 to about 19 gloss units as measured on a BYK 75 degree micro gloss meter. "Gloss units" refers to Gardner Gloss Units (ggu) measured on plain paper (such as Xerox 90 gsm COLOR XPRESSIONS+ paper or Xerox 4200 paper). The toners may reach 20 gloss units (TG40) at a temperature of, for example, from about 170° C. to about 210° C., such as from about 180° C. to about 200° C., or from about 185° C. to about 195° C.

The melt flow index (MFI) of the toners may be determined by methods within the purview of those skilled in the art, including the use of a plastometer. For example, the MFI of the toner may be measured on a Tinius Olsen extrusion plastometer at about 130° C. with about 10 kilograms load force. Samples may then be dispensed into the heated barrel of the melt indexer, equilibrated for an appropriate time, such as from about five minutes to about seven minutes, and then the load force of about 10 kg may be applied to the melt indexer's piston. The applied load on the piston forces the molten sample out a predetermined orifice opening. The time for the test may be determined when the piston traveled one inch. The melt flow may be calculated by the use of the time, distance, and weight volume extracted during the testing procedure.

MFI as used herein refers to the weight of a toner (in grams) that passes through an orifice of length L and diameter D in a 10 minute period with a specified applied load (as noted above, 10 kg). An MFI unit of 1 thus indicates that only 1 gram of the toner passed through the orifice under the specified conditions in 10 minutes time, "MFI units" as used herein thus refers to units of grams per 10 minutes.

Toners of the present disclosure subjected to this procedure may have varying MFI depending on the pigment utilized to form the toner. A black toner may have an MFI from about 30 gm/10 min to about 100 gm/10 min, such as from about 36 gm/10 min to about 47 gm/10 min; a cyan toner may have an MFI from about 30 gm/10 min to about 100 gm/10 min, such as from about 36 gm/10 min to about 46 gm/10 min; a yellow toner may have an MFI from about 12 gm/10 min to about 100 gm/10 min, such as from about 16 gm/10 min to about 35 gm/10 min; and a magenta toner may have an MFI of from about 45 gm/10 min to about 100 gm/10 min, such as from about 48 gm/10 min to about 52 gm/10 min.

The toners may have a fusing percentage of from about 50% to about 100%, or from about 60% to about 90%, or from about 50% to about 70%. The fusing percentage of an image may be evaluated in the following manner. Toner is fused from low to high temperatures depending upon initial set point. Toner adherence to paper is measured by tape removal of the areas of interest with subsequent density measurement. The density of the tested area is divided by the density of the area before removal then multiplied by 100 to obtain percent fused. The optical density is measured with a spectrometer (for example, a 938 Spectrodensitometer, manufactured by X-Rite). Then, the optical densities thus determined are used to calculate the fusing ratio according to the following Equation.

$$\text{Fusing (\%)} = \frac{\text{Area after removal}}{\text{Area before removal}} \times 100$$

Crease fix MFT is measured by folding images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT. The toner compositions may have a crease fix MFT of, for example, from about 115° C. to about 145° C., such as from about 120° C. to about 140° C., or from about 125° C. to about 135° C.

The toners may also possess excellent charging characteristics when exposed to extreme relative humidity (RH) conditions. The low-humidity zone may be about 12° C./15% RH, while the high humidity zone may be about 28° C./85% RH. Toners of the present disclosure may possess a parent toner charge per mass ratio (Q/M) of from about −2 μC/g to about −50 μC/g, such as from about −4 μC/g to about −5 μC/g, and a final toner charging after surface additive blending of from −8 μC/g to about −40 μC/g, such as from about −10 μC/g to about −25 μC/g.

The toners may exhibit a high hot offset temperature of, for example, from about 200° C. to about 230° C., such as from about 200° C. to about 220° C., or from about 205° C. to about 215° C.

The toner compositions may have a flow, measured by Hosakawa Powder Flow Tester. Toners of the present disclosure may exhibit a flow of from about 10 to about 55%, such as from 30 to about 50%, or from about 15 to about 40%.

The toner composition may be measured for compressibility, which is partly a function of flow. Toners of the present disclosure may exhibit a compressibility of from about 8 to about 16%, such as from about 12 to about 16%, or from about 9 to about 14% at 9.5 to 10.5 kPa.

The density of the toner compositions may be measured by densitometer. Toners of the present disclosure may exhibit a density of from about 1.2 to about 1.8, or from about 1.3 to about 1.6, or from about 1.5 to about 1.7.

Imaging

Toners in accordance with the present disclosure may be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure may be selected for electrophotographic imaging and printing processes such as digital imaging systems and processes.

Any known type of image development system may be used in an image developing device to form images with the toner set described herein, including, for example, magnetic brush development, single component development (SCD), hybrid scavengeless development (HSD), and the like. Because these development systems are known in the art, further explanation of the operation of these devices to form an image is not needed.

One benefit of the formulation disclosed herein that the reduction in contamination of the bias charge roll (BCR). These toners are particularly well-suited for use in printers with cleaning systems including a BCR and electrostatic roll for charging the photoreceptor. This means that the formulations are also particularly well-suited for use in small office printers.

The toner particles described herein can be used as single component developer (SCD) formulations that are free of carrier particles and deliver a very high transfer efficiency.

Typically in SCD, the charge on the toner is what controls the development process. The donor roll materials are selected to generate a charge of the right polarity on the toner when the toner is brought in contact with the roll. The toner layer formed on the donor roll by electrostatic forces is passed through a charging zone, specifically in this application a charging roller, before entering the development zone. Light pressure in the development nip produces a toner layer of the desired thickness on the roll as it enters the development zone. This charging typically will be for only a few seconds, minimizing the charge on the toner. An additional bias is then applied to the toner, allowing for further development and movement of the controlled portion of toner to the photoreceptor. If the low charge toner is present in sufficient amounts, background and other defects become apparent on the image. The image is then transferred from the photoreceptor to an image receiving substrate, which transfer may be direct or indirect via an intermediate transfer member, and then the image is fused to the image receiving substrate, for example by application of heat and/or pressure, for example with a heated fuser roll.

The following Examples are intended to be illustrative only and are not intended to limit the scope of the present disclosure.

EXAMPLES

Toners were prepared using a 10 liter Henschel blender by blending EA toner particles prepared by the aggregation process with the external additives, EA particles were prepared in the reactor. The general EA particle formulation is summarized below in Table 1. Water was added so that the reactor had a solids content of about 14%. The amount of secondary latex and wax was optimized to avoid issues in hot offset and minimum fusing. The target properties of the toner are a median volume of the dry particle of about 6.8-7.4 μm and a circularity of >0.962.

TABLE 1

Toner Particle Formulation

| Raw Material | Parts |
|---|---|
| Core latex (styrene/butyl acrylate) | 11.8 |
| Shell latex (styrene/butyl acrylate) | 8.79 |
| Secondary latex (crosslinked styrene/butyl acrylate) | 3.52 |
| Regal 330 (carbon black pigment) | 2.77 |
| Pigment Blue 15:3 (cyan pigment) | 0.71 |
| Wax dispersion | 4.51 |
| Polyaluminum chloride (PAC) | 0.187 |

The toner formulation was found to be about 5-10% secondary latex, about 8-15% wax, 3-6% carbon black pigment, 1% cyan pigment using a latex resin having a particle size of about 180 to about 280 nm, at about 40% solids and about 25 to about 35% in the shell. The formulation is summarized below in Table 2.

TABLE 2

Percentage Range of Dry Toner Particle

| | |
|---|---|
| Toner Particle | 100 |
| Bulk Resin | 35-45 |
| Shell Resin | 25-35 |
| Secondary Latex | 5-10 |
| Regal 330Pigment | 3-6 |
| PB 15:3 Pigment | 1.00 |
| Wax | 8-15 |

Various additive packages were added to the general particle composition listed above to create seven different exemplary toners.

Example 1

Example 1 was prepared by Henschel blending of components for 5 to 15 minutes at 2500-3500 RPM.

Example 2

Example 2 was prepared in the same way as Example 1,

The examples were prepared by an emulsion aggregation (EA) process. Toner particles were formed through an EA process by combining a styrene/butylacrylate latex polymer with a low viscosity wax, nano-sized crosslinked styrene/n-butylacrlyate gel, carbon black, and cyan pigments in a ratio of 10.2:2:1 in a reaction vessel. Polyaluminum chloride was then added to the system and the mixture homogenized. Once homogenized, the mixture was heated to near the glass transition temperature (50-60° C.) of the polymer until the particle reached pre-shell size of 6.0-6.5 μm. Once the aggregate was at the appropriate size, the same polymer latex was added to create a shell of no less than 20% of the total latex addition. After the shell was added, the reaction vessel was held at temperature for a period of time and then a base was added to freeze the particle size and reduce the slurry viscosity. Once done ethylenediaminetetraacetic acid was added as a sequestering agent for reduction of aluminum, After freezing the particle batch temperature was raised to no less than 90 C and the pH was adjusted up. The batch then coalesced for a period of time until a circularity (roundness) of the particle was 0.962 or greater. The batch was then cooled, pH was adjusted up to 8-9, washed, and dried. The dried particle was then taken and blended with an additive package to produce a toner. The additive package included 1.5-3.5 wt % medium PDMS silica, 0.05-0.35 wt % large sol gel silica, 0.25-0.75 wt % medium HMDS silica, and 0.35-0.75 wt % 400 nm PMMA organic spacer.

Fusing and Compressibility Testing

Toner compressibility was measured by a Freeman FT4 powder flow rheometer. Table 3 provides the results of compressibility tests for Examples 1 and 2.

Compressibility is a function of at least flow. Examples 1 and 2 all showed improved flow. As discussed above, flow is important in higher speed printing.

TABLE 3

Compressibility Results

| | 2 kPa | 6 kPa | 8 kPa | 10 kPa | 14 kPa |
|---|---|---|---|---|---|
| Example 1 | 6.66 | 9.14 | 9.69 | 10.1 | 10.92 |
| Example 2 | 5.9 | 8 | 8.45 | 8.9 | 9.86 |

Fusing was also tested for Examples 1 and 2. Fusing was measured at various temperature from 150° C. to 220° C. Fix of about 80% was achieved at 160° C., while about 100% fusing was achieved at 180° C. No cold or hot offset was observed.

Testing Conditions

The examples were next put through testing at two extreme printing conditions. First, cold and dry printing conditions; and second, warm and humid printing conditions. It is desirable that toners and developers be functional under a broad range of environmental conditions to enable good image quality from a printer. Thus, it is desirable for toners and developers to function at low humidity and low temperature, for example at 50° F. and 20% relative humidity, and high humidity and temperature, for example at 80° F. and 80 to 85% relative humidity.

Density

The image density was tested by Xrite densitometer. After printing, the results were measured using a handheld machine to calculate the image density of a controlled area of the printed page.

The image density was unexpectedly high for Examples 1 and 2. Higher density results in a darker picture on the printed page. Examples 1 and 2 achieved a high image density while using less toner.

Storage Stability

The storage stability of this toner was excellent.

Melt Flow

Melt flow index of the toner using the Tinius Olsen flow meter was 79.5 gm/10 min.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner composition comprising:

toner particles comprising:

a resin;

an optional wax; and an optional colorant; and a surface additive at least partially coating toner particle surfaces, the surface additive comprising a mixture of:

a hexamethyldisilazane (HMDS) surface treated silica, a sol-gel silica that is not surface treated, and a polydimethylsiloxane (PDMS) surface treated silica, wherein:

a weight ratio of the HMDS surface treated silica to the PDMS surface treated silica is in a range of from about 1:2 to about 1:14; and the surface additive further comprises an organic spacer having a volume average diameter of from about 300 to about 600 nm.

2. The composition of claim 1, wherein the HMDS surface treated silica has an average particle diameter of from about 5 to about 50 nm.

3. The composition of claim 1, wherein the sol-gel silica has an average particle diameter of from about 100 to about 150 nm.

4. The composition of claim 1, wherein the PDMS surface treated silica has an average particle diameter of from about 5 to about 50 nm.

5. The composition of claim 1, wherein a weight ratio of the HMDS surface treated silica to the sol-gel silica is in a range of from about 2:1 to about 4:1.

6. The composition of claim 1, wherein a weight ratio of the HMDS surface treated silica to the sol-gel silica to the PDMS surface treated silica is about 1:0.5:3.

7. The composition of claim 1, wherein a mixture of the HMDS surface treated silica and the sol-gel silica is present in the toner composition in an amount of from about 0.50 to about 1.20 wt % based on a total weight of the toner composition.

8. The composition of claim 1, wherein the mixture of the HMDS surface treated silica, the sol-gel silica, and the PDMS surface treated silica is present in the toner composition in an amount of from about 3.0 to about 5.0 wt % based on a total weight of the toner composition.

9. The composition of claim 1, wherein the toner particles comprise a modified paraffin wax having branched carbons in combination with linear carbons.

10. The composition of claim 1, wherein the toner particles comprise:

a core and a shell, the core comprising a resin including a first non-crosslinked polymer in combination with a crosslinked polymer, and the shell comprising a second non-crosslinked polymer present in an amount of from about 20 to about 40 wt % of the toner;

a modified paraffin wax possessing branched carbons in combination with linear carbons; and an optional colorant.

11. The composition of claim 10, wherein the first non-crosslinked polymer, the second non-crosslinked polymer, or both, comprise at least one monomer selected from the group consisting of styrenes, acrylates, methacrylates, butadienes, isoprenes, acrylic acids, methacrylic acids, acrylonitriles, and combinations thereof.

12. The composition of claim 10, wherein the crosslinked polymer is present in an amount of from about 6 to about 14 wt % of the toner.

13. The composition of claim 1, wherein the toner particles have a circularity of from about 0.940 to about 0.999.

14. The composition of claim 1, wherein the toner particles have a volume average diameter of from about 3 to about 12 μm.

15. The composition of claim 1, wherein the mixture is present in the toner composition in an amount from about 2.5 to about 6.0 wt % based on the total weight of the toner composition.

16. A method of making a toner composition, the method comprising:

forming a slurry by mixing together:

an emulsion containing a resin;

optionally a wax;

optionally a colorant;

optionally a surfactant;

optionally a coagulant;

optionally a chelating agent; and one or more additional optional additives;

heating the slurry to form aggregated particles in the slurry;

freezing aggregation of the particles by adjusting the pH;

heating the aggregated particles in the slurry to coalesce the particles into toner particles;

washing and drying the toner particles; and coating the toner particles with a surface additive comprising a mixture of:

a hexamethyldisilazane (HMDS) surface treated silica, a sol-gel silica that is not surface treated, and a polydimethylsiloxane (PDMS) surface treated silica, wherein:

a weight ratio of the HMDS surface treated silica to the PDMS surface treated silica is in a range of from about 1:2 to about 1:14; and the surface additive further comprises an organic spacer having a volume average diameter of from about 300 to about 600 nm.

17. The method of claim 16, wherein:

the HMDS surface treated silica has an average particle diameter of from about 5 to about 50 nm, and the sol-gel silica has an average particle diameter of from about 100 to about 150 nm.

18. The method of claim 16, wherein a weight ratio of the HMDS surface treated silica to the sol-gel silica is in a range of from about 2.0:1.0 to about 4:1.

19. The method of claim 16, wherein a weight ratio of the HMDS surface treated silica to the sol-gel silica to the PDMS surface treated silica is about 1.0:0.5:3.0.

20. The method of claim 18, wherein a mixture of the HMDS surface treated silica and the sol-gel silica is present in the toner composition in an amount of from about 0.5 to about 1.2 wt % based on a total weight of the toner composition.

21. The method of claim 19, wherein the mixture of the HMDS surface treated silica, the sol-gel silica, and the PDMS surface treated silica is present in the toner composition in an amount of from about 3.0 to about 5.0 wt % based on a total weight of the toner composition.

22. The method of claim 16, wherein the mixture of the HMDS surface treated silica, the sol-gel silica, the PDMS surface treated silica, and the organic spacer is present in the toner composition in an amount of from about 3.8 wt % to about 5.8 wt % based on a total weight of the toner composition.

* * * * *